US005115754A

United States Patent [19]

Gray et al.

[11] Patent Number: 5,115,754

[45] Date of Patent: May 26, 1992

[54] ADJUSTABLE SPREADER ARMS FOR SAILING GRAFT

[76] Inventors: Alan J. Gray, 660 Rocky Point Road; Bruce D. Flett, 1/506A Rocky Point Road, both of Sans Souci, New South Wales 2219, Australia

[21] Appl. No.: 565,015

[22] Filed: Aug. 9, 1990

[30] Foreign Application Priority Data

Aug. 10, 1989 [AU] Australia ..... PJ5703

[51] Int. Cl.[5] ..... B63B 15/00

[52] U.S. Cl. ..... 114/101; 114/90; 114/102

[58] Field of Search ..... 114/101, 102, 89, 90, 114/97, 98, 109, 111; 212/266

[56] References Cited

U.S. PATENT DOCUMENTS 4,230,060 10/1980 McCoy ..... 114/102 X 4,313,391 2/1982 Hall ..... 114/90

FOREIGN PATENT DOCUMENTS 443954 2/1968 Fed. Rep. of Germany .

*Primary Examiner*—Ed Swinehart

*Attorney, Agent, or Firm*—Cushman, Darby & Cushman

[57] ABSTRACT

A system for adjusting spreaders and diamonds on sailing boats, the system being adapted to provide spreaders or diamonds which are adjustable on the water thus allowing the craft's crew greater control of the sailing rig. The system has a pair of spreader arms pivotally connected to a pair of control arms attached to a mast. The spreader arms are adjustable by means of a halyard which runs via the control arms to distal ends of the spreader arms. The spreader arms have a number or holes or slots proximate their distal ends to receive respective port and starboard stays of the sailing craft. Depending on prevailing wind conditions, the spreader arms may be selectively pivoted forward towards the control arms by a pulling force applied to the halyard. In this way, the shape and bend characteristics of the mast may be altered by the crew so as to control the amount of draft in the sails and to affect the amount of power generated by the sailing rig.

9 Claims, 2 Drawing Sheets

ADJUSTABLE SPREADER ARMS FOR SAILING GRAFT

BACKGROUND OF THE INVENTION

The present invention relates to a system for adjusting spreaders and diamonds on sailing boats.

The positioning of spreaders and diamonds may be changed so as to influence the shape and bend characteristics of the mast of the sailing craft.

By altering the shape and bend characteristics of the mast, the crew can control the amount of draft in the sails, thereby affecting the amount of power generated by the sailing rig.

It is well known to adjust spreaders and diamonds to suit the prevailing wind conditions. However, previous systems have proved to be totally ineffectual in achieving on-the-water adjustment of the spreaders and diamonds. That is, the angle of the spreader arms have previously only been adjusted and then locked into the desired position on the shore prior to racing, thereby requiring the crew of the sailing boat to make a very accurate forecast of wind conditions. Of course this does not take into account changes in wind conditions which may occur during the race.

It would be advantageous for the angle to the centre line of the sailing craft of both the port and starboard spreaders or diamonds to be simultaneously, infinitely and accurately adjustable whilst the sailing craft is on the water and the sailing rig is under load.

OBJECT OF THE INVENTION

It is the object of the present invention to provide spreaders or diamonds which are adjustable on the water thus allowing the craft's crew greater control of the sailing rig.

DISCLOSURE OF THE INVENTION

In the broad form the present invention provides shroud spreader means adapted to radially space shrouds from a mast of a sailing craft, the spreader means comprising:

pivotable spreader arms adapted to extend in a plane generally perpendicular to the mast interjacent top and bottom ends thereof, respective distal ends or end segments of the spreader arms being engagable with respective shrouds, a control arm or arms adapted to extend radially from the mast in said plane and being generally coextensive with and angularly spaced fore or aft of the spreader arms, and an adjusting means operatively connected to the spreader arms via the control arm(s) and adapted to selectively pivot the spreader arms.

Preferably, two spreader arms are provided, the control arm comprises at least two fixed arms, and the adjusting means is a flexible elongate member. Typically, the spreader arms are pivotally mounted to respective fixed arms proximate the mast so as to be generally coextensive with, and angularly displaced from respective fixed arms. Generally, the flexible elongate member is connected at one end to the distal end of the spreader arm via the distal end of the respective fixed arm whereby a pulling movement thereof will pivot said spreader arm towards the fixed arm so as to adjust the position of said shroud relative to said mast.

Preferably, the flexible elongate member also passes through a transmission means adapted to provide a mechanical advantage between the force applied to one end of the elongate member, and the force applied by the other end of the elongate member to respective ends of the spreader arms.

DESCRIPTION OF THE PREFERRED EMBODIMENT

A preferred form of the present invention will now be described by way of example with reference to the accompanying drawings, wherein.

Figure 1:
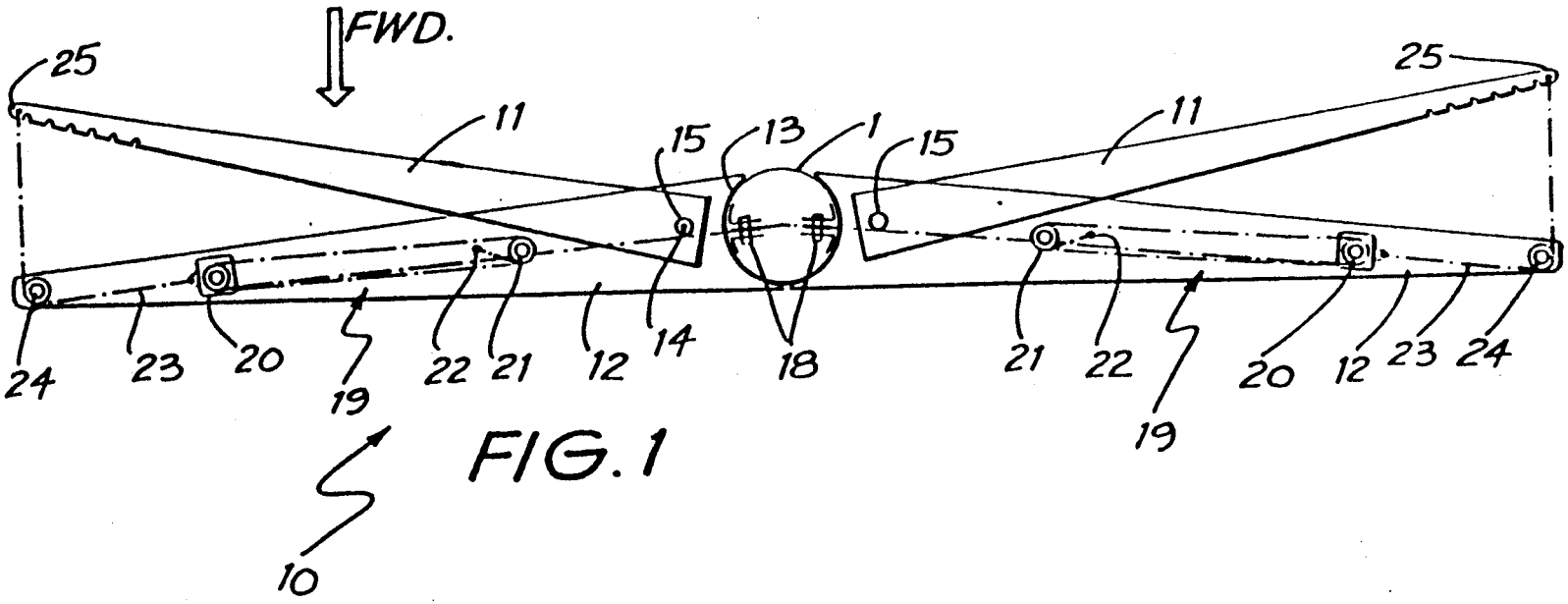
FIG. 1 is a schematic top plan view of the adjustable spreader arm system of the present invention.
Figure 2:
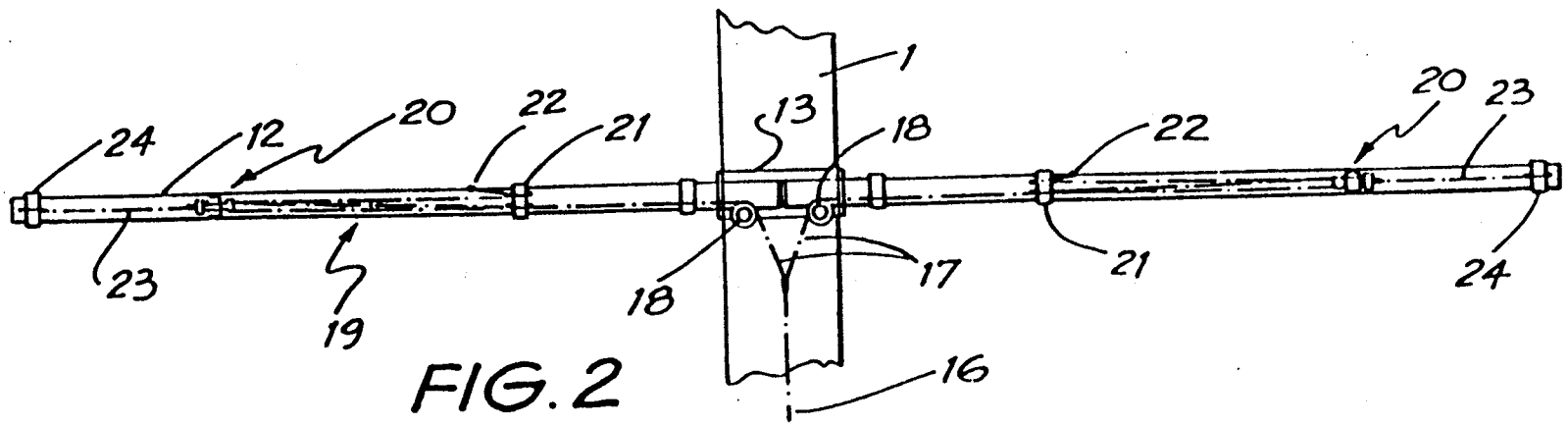
FIG. 2 is a front elevational view of the apparatus depicted in FIG. 1.
Figure 3:
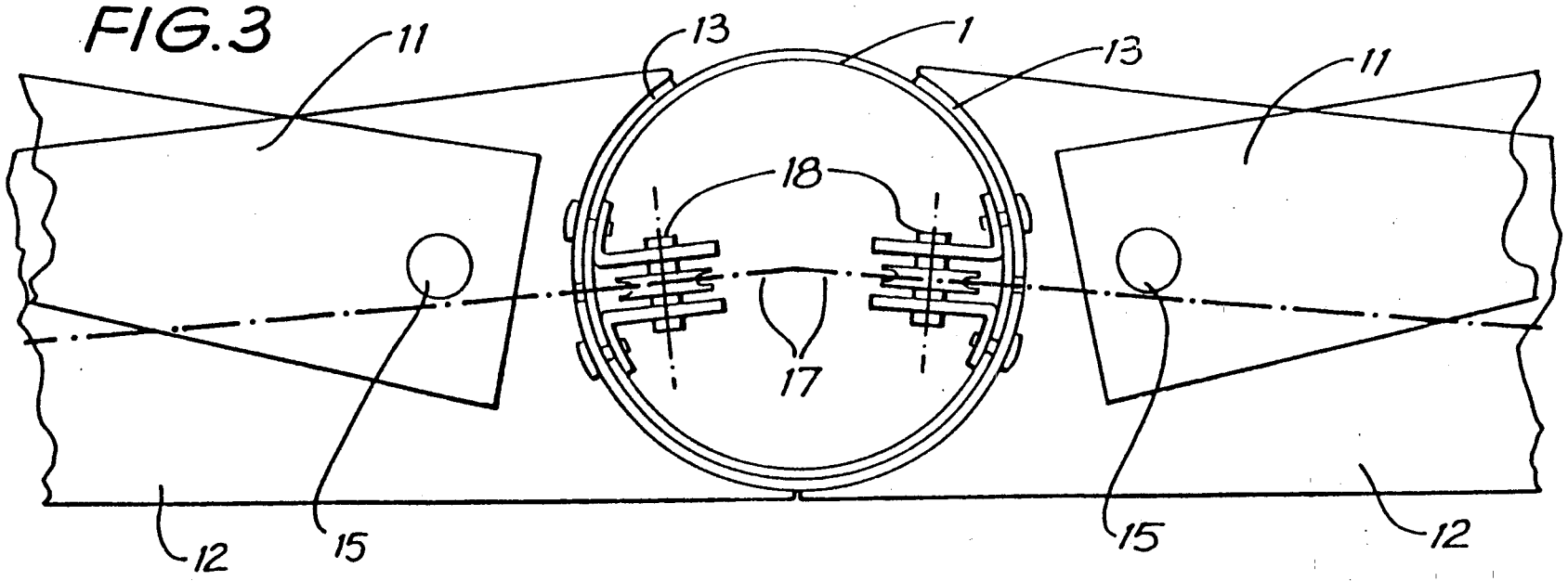
FIG. 3 is an enlarged top plan view of the apparatus depicted in FIG. 1.
Figure 4:
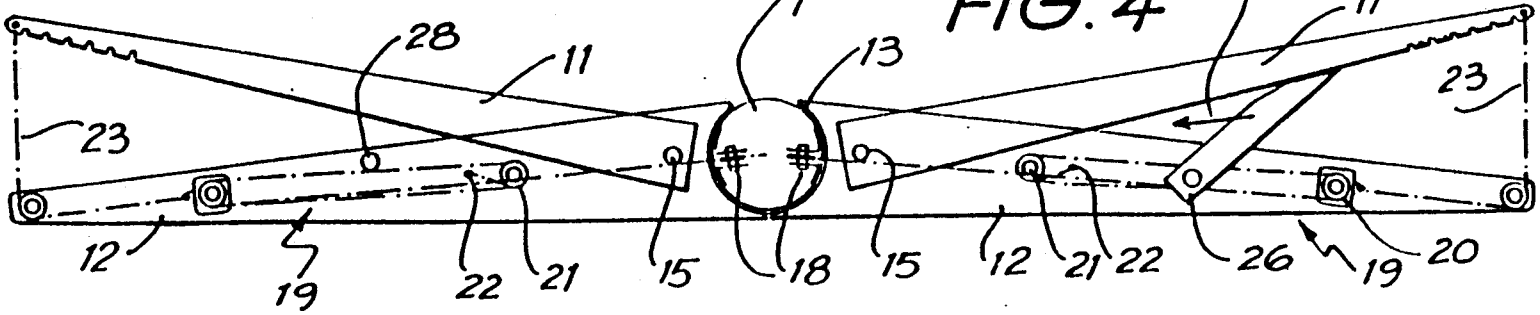
FIG. 4 is another top plan view similar to FIG. 1, but showing optional features.

There is depicted an adjustable spreader arm system 10 comprising two spreader arms 11 which are pivotably mounted with respect to the mast 1 of a sailing craft.

The system 10 comprises a yoke 13 which is fixedly mounted at a predetermined distance from the top end of the mast 1. Two control arms 12 extend in generally opposite directions from, and are fixed to the yoke 13. The control arms 12 extend in directions generally normal to the direction of movement of the sailing craft. The spreader arms 11 are pivotably mounted to respective control arms 12 about pivot pins 15 which define the pivot axis 14. The pivot axes 14 of the spreader arms 11 are adjacent the mast 1, and the spreader arms 11 are generally coextensive with and angularly displaced aft of the respective control arms 12.

The system 10 also comprises a spreader arm adjusting means comprising a halyard 16 which extends within the mast 1 from a convenient position on the sailing craft up to the spreader arm assembly. The halyard 16 is connected to the ends of two cables 17 which extend to respective sides of the system 10 via respective blocks 18. Each of the cables 17 extend through a pulley system 19. That is, each cable 17 passes round a first pulley 20 which is freely movable with respect to the control arm 12, then back and around a second pulley 21 which is fixed to the control arm 12, again around the first pulley 20, again around the second pulley 21. The other ends 22 of the cables are fixed to the control arm 12 proximate the second pulley 21.

Auxiliary cables 23 are attached at one end to the first pulley 20, extend around another pulley 24 proximate the end of the respective control arms 12, and are attached at their other end to the distal end 25 of each spreader arm.

The pulley assembly provides a mechanical advantage whereby a pulling force applied to the halyard 16 will be multiplied by the pulley system 19 and applied to the spreader arms 11 by the auxiliary cables 23. This avoids large compression forces from being exerted on the mast 1 by the halyard 16.

In use, the spreader arms 11 will be angularly displaced approximately 10° to 20° aft of the control arms 12. Depending on the wind conditions, the spreader arms 11 may be selectively pivoted forward towards the control arms by a pulling force applied to the halyard 16. In this way, the shape and bend characteristics of the mast 1 may be altered by the crew so as to control the amount of draft in the sails and which affects the amount of power generated by the rig.

Alternatively, the halyard 16 may be left untensioned whereby the spreader arms 11 are freely rotatable about the pivot axes 14. This is desirable in heavy breezes. When untensioned, the spreader arms will assume a normal position wherein the tension in the shrouds is a minimum.

It may sometimes be desirable to maintain the spreader arms at a predetermined position aft of its normal position. Accordingly, the system 10 may further comprise a locking arm 26 which is pivotably attached at one end to the control arm. When pivoted away from the control arm 12 the locking arm 26 engages the spreader arm 11 aft. A further halyard 27 attached at an intermediate position of the locking arm and which extends to a convenient position on the sailing craft for operation by a crew member is provided.

The halyard 27 may be tensioned so as to restrict forward movement of the spreader arm 11. Alternatively, a pin 28 may be provided to restrict the forward movement of the spreader arm 11.

The system 10 may comprise two sets of control arms, the first set being angularly displaced forward of the spreader arms' normal position, and the second set angularly displaced aft of the spreader arms' normal position. Each set of control arms would comprise a halyard to act on respective pully systems so as to selectively pull the spreader arms either forward or aft of their normal positions.

The spreader arms may comprise a plurality of slots or holes 29 which are equally spaced inwardly from the outer ends of the spreader arms and which are each adapted to receive the shrouds. This provides a further adjustment of the rig for varying the tension in the shrouds.

The adjustable spreader arm system provides a convenient means of adjusting the position of the spreader arms relative to the mast so that the crew of the sailing craft may selectively control the amount of draft in the sails thereby affecting the amount of power generated by the sailing rig.

What is claimed is:

1. Shroud spreader means adapted to radially space shrouds from a mast of a sailing craft, the spreader means comprising:

pivotable spreader arms adapted to extend in a plane generally perpendicular to the mast interjacent top and bottom ends thereof, respective distal end portions of the spreader arms being engagable with respective shrouds, control arms adapted to extend radially from the mast in said plane and being generally coextensive with and angularly spaced fore or aft of the spreader arms, and an adjusting means operatively connected to the spreader arms via the control arms and adapted to selectively pivot the spreader arms.

2. The shroud spreader means as claimed in claim 1 wherein two spreader arms are provided each being adapted to extend radially from opposing lateral sides of the mast.

3. The shroud spreader means as claimed in claim 1 wherein the adjusting means is a flexible elongate member.

4. The shroud spreader means as claimed in claim 1 wherein the spreader arms are pivotally mounted to respective control arms proximate the mast.

5. The shroud spreader means as claimed in claim 3 wherein the elongate member is connected at one end to the distal end of the spreader arms via the distal end of the respective control arms such that a pulling movement thereof will pivot the spreader arms towards the control arms so as to adjust the position of the shroud relative to the mast.

6. The shroud spreader means as claimed in claim 5 wherein the flexible elongate member passes through a transmission means adapted to provide a mechanical advantage.

7. The shroud spreader means as claimed in claim 1 further comprising a locking arm pivotally attached at one end thereof to a control arm and adapted to engage with the respective spreader arm so as to lock the spreader arm in a desired angular position.

8. The shroud spreader means as claimed in claim 7 wherein a halyard is attached at one end thereof to an intermediate position of the locking arm and is adapted to extend to an operational position within the sail craft.

9. A sailing craft comprising a mast adapted to be mounted upright on a hull so as to extend upwardly therefrom, the mast being adapted to be supported in said upright position by at least a fore stay which extends from a position proximate the upper end of the mast to the fore end of the craft, and by shrouds on both the port and starboard sides of the mast which extend from a position proximate the upper end of the mast to the port and starboard sides of the craft, the sailing craft further comprising a shroud spreader means as claimed in claim 1.

* * * * *